US006731069B1

(12) United States Patent
Newell et al.

(10) Patent No.: US 6,731,069 B1
(45) Date of Patent: May 4, 2004

(54) MERCURY-FREE METAL HALIDE ARC LAMPS

(75) Inventors: P. Bruce Newell, Carlisle, MA (US); Nanu Brates, Malden, MA (US); Elliot F. Wyner, Peabody, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/413,923

(22) Filed: Oct. 7, 1999

Related U.S. Application Data

(60) Provisional application No. 60/129,201, filed on Apr. 14, 1999.

(51) Int. Cl.[7] ..... H01J 61/18

(52) U.S. Cl. ..... 313/643; 313/567; 313/25

(58) Field of Search ..... 313/17, 25–26, 313/493, 567–68, 636, 637, 642, 643, 638

(56) References Cited

U.S. PATENT DOCUMENTS

| | | | | | |
|---|---|---|---|---|---|
| 4,757,236 | A | * | 7/1988 | Dakin et al. | 313/643 X |
| 4,866,342 | A | * | 9/1989 | Ramaiah et al. | 313/639 |
| 5,394,057 | A | * | 2/1995 | Russell et al. | 313/637 X |
| 5,973,453 | A | * | 10/1999 | Van Vliet et al. | 313/623 |
| 6,069,456 | A | * | 5/2000 | Fromm et al. | 313/637 X |

* cited by examiner

*Primary Examiner*—Vip Patel
*Assistant Examiner*—Joseph Williams
(74) *Attorney, Agent, or Firm*—William H. McNeill

(57) ABSTRACT

A mercury-free metal halide arc lamp having an arc vessel of fused silica, an aspect ratio greater than 5, and containing a noble gas such as xenon, argon or krypton and a metal halide. In a preferred embodiment, the arc vessel has a diameter of 8 mm and a length of 80 mm, a fill of sodium/scandium iodides and a buffer gas of xenon.

3 Claims, 3 Drawing Sheets

MERCURY-FREE METAL HALIDE ARC LAMPS

This application claims priority from Provisional Application No. 60/129,201, filed Apr. 14, 1999.

FIELD OF THE INVENTION

This invention relates to metal halide arc lamps and, more particularly, to a mercury-free, metal halide arc lamp operating in a range of from 250 to 400 watts.

BACKGROUND OF THE INVENTION

Present day metal halide arc lamps evolved from pure mercury arc lamps developed earlier this century. The early design consisted of an envelope containing mercury and perhaps a small amount of noble gas to aid in starting. Mercury was originally found to be an ideal arc medium, because it is a liquid having a low vapor pressure at room temperature. Thus, it was easy to strike and sustain an arc. At operating temperatures, mercury becomes completely vaporized, pressure becomes quite high, and the voltage across the lamp increases to the point where efficient power supplies can drive the lamp.

The metal halide lamp or metal halide arc is an improvement to the mercury lamp. In addition to mercury and noble gas, it also contains salts of elements that emit desired radiation. Salts are used because they typically have higher vapor pressures than do the elements themselves. Thus, more of the element reaches the arc stream at a given envelope temperature.

The metal halide arc lamp is more efficient than a pure mercury lamp, because the elements are chosen to emit in the visible region of the spectrum. Also, the salts can be chosen to provide a particular color and color rendition, thus making the metal halide are lamp a most attractive, high performance light source. Designers specify metal halide arc lamps in high power applications, such as streetlights and high bay illumination. However, in present day lighting systems, with improved lamp and system technology, metal halide arcs are used in lower power applications.

Although metal halide arc lamps are superior to pure mercury lamps in efficacy, color, and color rendition, they contain mercury. There are two important reasons for this: (a) the mercury arc lamp is the archetype of arc lamp technology, and has evolved from the earlier, simpler design; and (b) the designer can use the vapor pressure-temperature characteristics of mercury to make lamps that are easy to start and that operate at convenient voltages.

A major disadvantage of lamps that contain mercury is reflected in the fact that mercury is a toxic material that will eventually be disposed of into the environment. Present day manufacturers seek to reduce and/or eliminate mercury from their products whenever possible.

It is, therefore, one of the objectives of the present invention to provide a workable, efficient, metal halide arc lamp that is free of mercury.

It is difficult to design a metal halide arc lamp without mercury. Leaving the mercury out of currently available metal halide arc lamps yields lamps with very low operating voltages. At reasonable currents, the power into these lamps is insufficient to raise the envelope temperature high enough to vaporize the salts. The voltage and the power can be increased by increasing the pressure of the noble gas. However, this makes the lamps difficult, if not impossible, to start.

The present invention reflects the discovery that a mercury-free metal halide arc lamp can be obtained by decreasing the bore size and increasing the arc length. This increases the lamp voltage and the initial power draw. The arc length divided by the bore diameter is herein referred to as the "aspect ratio". By way of definition, this application defines lamps with aspect ratios greater than 5 as tubular. The inventors have developed a tubular metal halide arc lamp having an arc length of 80 mm, a bore diameter of 8 mm, and containing a noble gas fill of 100 torr xenon. Initial metal halide arc lamps with this configuration produced starting voltages of 40 to 50 volts. At currents of 5 amperes to 7 amperes, this lamp consumed about 250 watts, which was sufficient to raise the operating temperature of the lamp to a suitable value. Later metal halide arc lamp designs in accordance with this invention were found to operate more efficiently at 400 watts.

SUMMARY OF THE INVENTION

It is, therefore, an object of this invention to obviate the disadvantages of the prior art.

It is another object of this invention to provide an improved metal halide arc lamp.

It is yet another object of the invention to provide a metal halide arc lamp that is free of mercury.

Yet another object of the invention is the provision of an environmentally friendly arc lamp.

In accordance with one aspect of the invention, there is provided a mercury-free metal halide arc lamp. The metal halide arc lamp has an envelope of fused silica, an aspect ratio greater than 5, and contain a noble gas such as xenon, argon or krypton and a metal halide. The lamp has fill chemistries comprising iodides of sodium/scandium and iodides of sodium/rare-earth. Sodium, scandium, and various rare earths are known to emit strongly in the visible region of the spectrum. The sodium/scandium molar ratio is varied in a range from about five or six to one, up to eleven to one. The fill chemistries can include cesium. Cesium is known to affect the diameter of the arc, and to some extent the voltage. The lamp operates in a range from approximately 250 to 500 watts.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 2A:
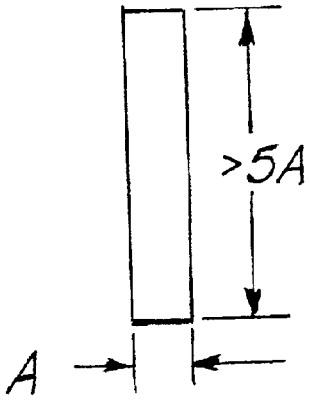
FIG. 2*a* is a diagrammatic, elevational view of an aspect of the invention.
Figure 2B:
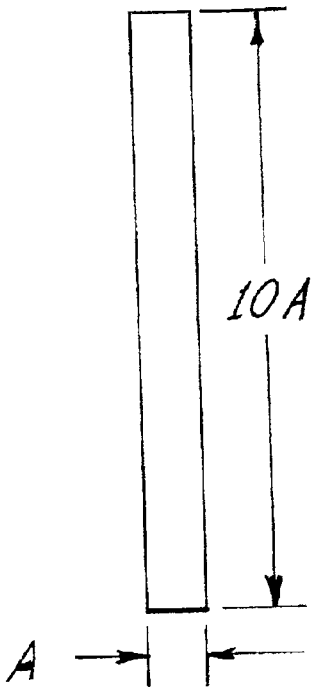
FIG. 2*b* is a diagrammatic, elevational view of a preferred embodiment of the invention.

Referring now to the drawings with greater particularity, there is shown diagrammatically in FIG. 2*a* an arc tube 14 having an aspect ratio greater than 5 in accordance with the general precepts of the invention and in FIG. 2*b* an arc tube having an aspect ratio of about 10, in accordance with a preferred embodiment of the invention. In FIGS. 2*a* and 2*b* the diameter of the arc tube is indicated by the letter A, while the legends >5A and 10A refer to the arc length.

Figure 3:
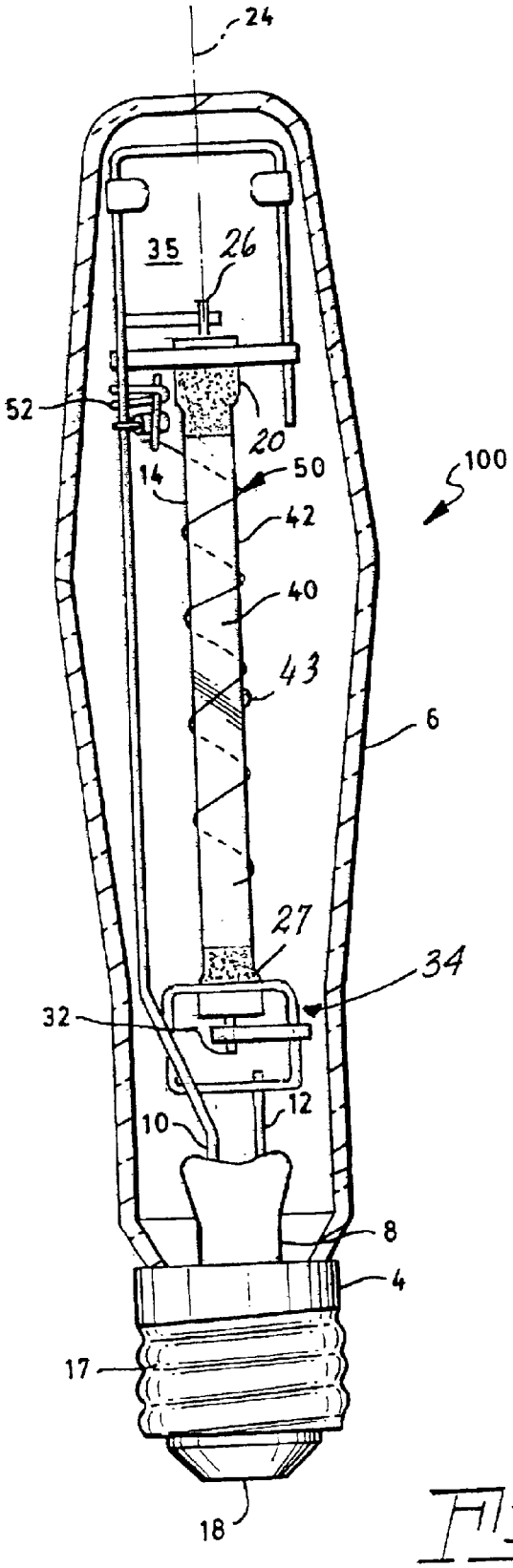
FIG. 3 is a perspective view of a metal halide lamp employing an embodiment of the invention.

FIG. 3 shows such an arc tube 14 as the light source in a metal halide lamp 100. The lamp 100 has a vitreous outer envelope 6 with a standard mogul screw base 4 attached to the stem end which is sown lowermost in the figure. A reentrant stem 8 has a pair of relatively heavy lead-in conductors 10 and 12 extending through the stem 8 and having outer ends thereof connected to the screw shell 17 and the eyelet 18.

The lamp 100 has arc tube 14 centrally located within the outer envelope 6. The arc tube 14 is comprised of a length of light transmitting fused silica. The arc tube 14 contains a charge of vaporizable metal which may include the addition of a buffer gas and which is mercury free. The upper end of the arc tube 14 is closed by a pinch seal 20 through which an in-lead 26 projects and supports an upper electrode (not shown). The lower end of the arc tube 14 is closed by a pinch seal 27 through which an in-lead 32 extends. The in-lead 32 mounts the other electrode within the arc tube. The arc tube 14 has a tungsten wire 50 coiled thereabout. The wire 50 is connected to one of the electrodes by a thermal switch 52 and is placed between the electrodes where the lowest breakdown voltage is achieved. The thermal switch opens when the lamp is warm so as to minimize electric fields across the tube wall. Arc tube 14 has an arc chamber 40 defined by walls 42 and has a sealed tubulation 43 through which the chemical fill and buffer gas is administered, and is held in position in the lamp envelope 6 by upper arc tube mounting structure 35 and lower arc tube mounting structure 34, thereby maintaining a position on axis 24.

Generally speaking, the invention features mercury-free metal halide, tubular arc lamps. The lamps have arc tubes having bore diameters ranging from 6 mm to 11 mm, and arc lengths ranging from 40 mm to 160 mm. The fill of the lamps includes five different chemistries. The chemistries comprise iodides of sodium/scandium and iodides of sodium/rare earth. Sodium, scandium, and various of the rare earths are known to emit strongly in the visible region of the spectrum. The sodium/scandium molar ratio is varied from about five or six to one, up to eleven to one.

Some of the fill chemistries comprise cesium. Cesium is known to affect the diameter of the arc and to some extent the voltage.

In addition, lithium can be used. Lithium is an element known to emit in the deep red part of the spectrum, and is used in metal halide arc lamps to improve color rendition A preferred embodiment of the invention comprises a mercury-free metal halide arc lamp having the following characteristics, shown in Table I.

TABLE I

| | |
|---|---|
| ARC LENGTH | 80 mm |
| BORE | 8 mm |
| CHEMISTRY | Various sodium-scandium blends with and without cesium or lithium. |
| ENVELOPE MATERIAL | Fused silica |
| BUFFER GAS | Xenon from 100 to 500 Torr |
| OUTER JACKET | Either air or vacuum |
| POWER | 300 watts |
| VOLTAGE | ≈60 volts |
| CURRENT | ≈5 amperes |

TABLE I-continued

| | |
|---|---|
| BALLAST | 240–480 v. AC w/linear reactor |
| LAMP EFFICACY | ≈80 Lumens/Watt |
| COLOR TEMPERATURE | ≈4300 Kelvin |
| COLOR RENDITION | ≈60 Ra |
| SALT-POOL TEMPERATURE | ≈800° C. in air |

Lamp Fabrication:

The arc vessels were fabricated using tubular fused silica with bores ranging from 6 mm to 11 mm and cut to length. A small tubulation was affixed to the side. Electrodes were pressed into each end. The arc vessel was processed and dosed with chemicals and gas through tubulation 43, which was then sealed. The arc vessel as prepared can be used in air, or it can be mounted on a frame and introduced into an outer jacket. The outer jacket can be exhausted or backfilled with an inert gas such as argon or nitrogen.

The mercury-free lamp, however, has two advantages over mercury-containing lamps: 1) owing to the high aspect ratio, the voltage immediately after starting is on the order of 40 volts, and the initial power is on the order of 250 watts. Under these conditions the lamp produces a significant amount of useful light immediately upon starting (conversely, low aspect ratio mercury-containing lamps must warm up before useful light is produced); and 2) the operating pressure in the mercury- free lamps is substantially less than that of low aspect ratio mercury-containing arc tubes. The possibility of catastrophic explosion is remote, because the energy stored in the envelope (pressure times volume) is not great.

Chemicals:

Typical sodium/scandium chemistries used in the invention arc vessels are shown in Table II.

TABLE II

| COMPOSITION | CHEMICAL | MOLAR RATIO | WEIGHT % RATIO |
|---|---|---|---|
| A | Na/Sc/Li iodides | 24:1:9.5 | 68:8:24 |
| B | Na/Sc/Cs iodides | 11:1:0.03 | 76.9:19.2:3.9 |
| C | Na/Sc/Cs iodides | 6:1:0.03 | 65.6:32.2:3.2 |
| D | Na/Sc iodides | 11:1 | 80:20 |
| E | Na/Sc iodides | 5:1 | 63.8:36.2 |
| F | MHP4 Dy:Ho:Tm:Na:Ti | 1:1:1:6:0.75 | 19.6:19.6:32.2:9 |

Chemical composition A is a standard sodium/scandium/lithium material used in low-watt, metal halide lamps formulated for 3000° Kelvin color temperatures. The first experimental lamps contained this chemical. Chemicals B, C, D and E are chemistries containing two ratios of sodium to scandium with and without cesium. Several of the lamps manufactured used the 11:1:0.03 formulation (B) to produce a 4000° Kelvin color temperature (CCT). Formulation E produces a high color temperature. Formulations D and E are similar to B and C but contain no cesium.

All of the lamps were dosed with 40 mg of chemicals. This is more than enough chemical needed to assure saturated vapor above the melt, but not so much as to occlude light emission. Before lighting the lamp for the first time, the salts were shaken to one end of the lamp, called the salt pool or cold spot, where they melted as the lamp warmed up.

Buffer Gas:

Xenon is the buffer gas of choice because of its low thermal conductivity and its observed favorable effect on efficacy in standard metal halide lamps. Xenon was selected at 150 torr for the lamps because of the prior difficulty experienced with igniting arc tubes filled to 500 torr.

The vapor pressure of the chemicals listed above is only a few torr at the maximum service temperature of fused silica. Therefore, such pressure cannot significantly increase the total atomic density or decrease the mean free path. Moreover, the increase in conductivity due to the cations substantially balances the decrease in conductivity due to the electro-negative action of iodine. As a result, to first order, the buffer gas alone determined the lamp voltage.

Figure 1:
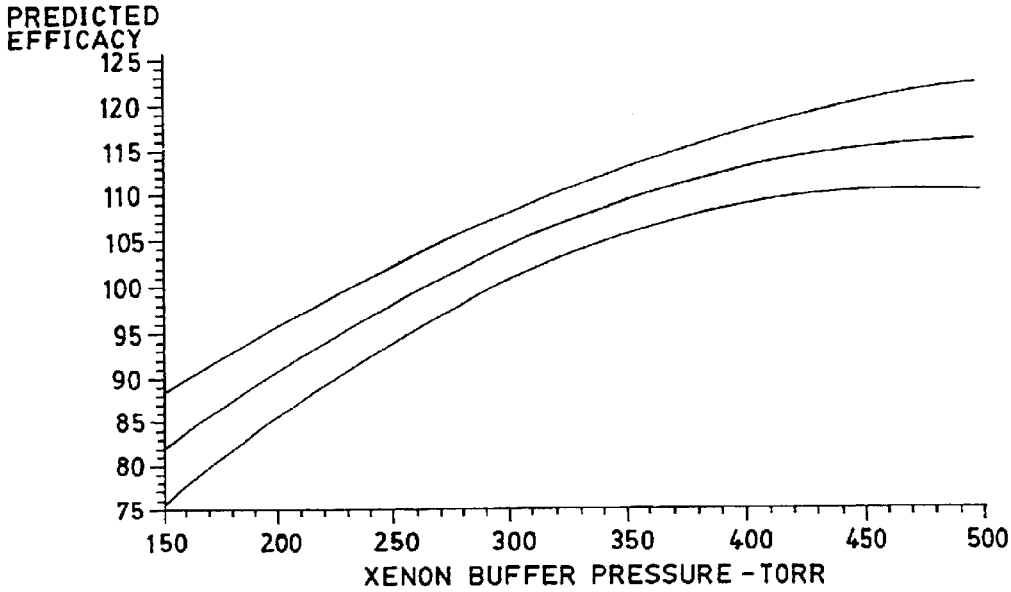
FIG. 1 illustrates a graphical view of the efficacy of a typical mercury-free metal halide arc lamp versus the xenon buffer pressure in toms.

Referring to FIG. 1, a graph of the efficacy of a mercury-free metal halide arc lamp is illustrated with respect to its xenon buffer pressure. The results indicate that a substantial increase in efficacy can be realized with high xenon buffer pressure. At 400 watts, it was observed that efficacies were achievable exceeding 115 lumens per watt at a xenon pressure of 500 torr. This result is consistent with observations bade with mercury containing lamps. The disadvantage is that the mercury-free lamp is difficult to start at this pressure.

Figure 1A:
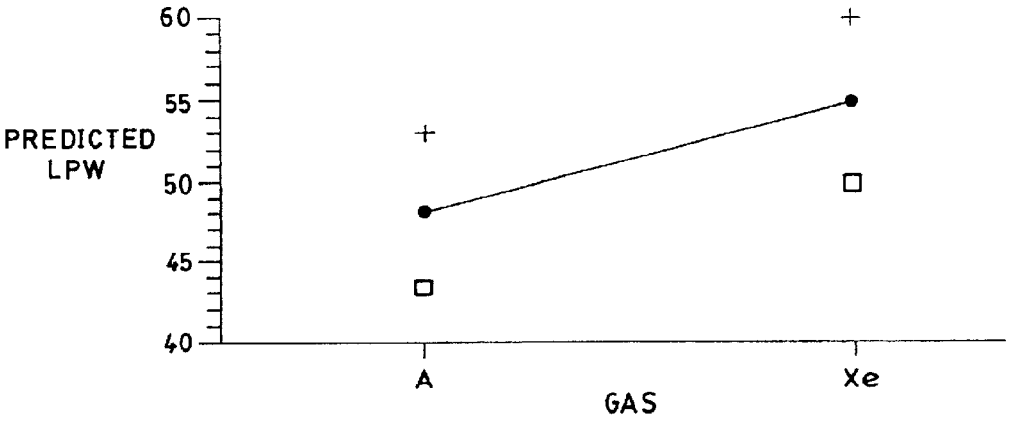
FIG. 1A shows a graphical view of predicted efficacy at 300 watts for a 7 mm bore lamp, with 24:1:2.2 Na/Sc/Li chemistry.

FIG. 1A shows the predicted effect of argon versus xenon at 150 torr at a power of 300 watts in a 7 mm bore arc tube burning in air. As expected, the regression indicates that xenon is more efficacious.

Analyses of color rendition yielded values near 60 Ra, with argon slightly higher than xenon. Analyses of voltage yielded values near 60 volts, with argon about 5 volts higher.

Wall Reactions:

A phenomenon that complicates the study of mercury-free lamps is the reaction of the chemicals with the envelope. There is an envelope temperature threshold above which the voltage increases uncontrollably, as this reaction takes place. Often the lamp extinguished in a short time revealing the deep, almost opaque, purple color of gaseous, free iodine in the arc tube. Once this happened, subsequent measurements revealed that the efficacy had decreased by 20% or more. Except for its permanent degradation of performance, iodine behaves very much like mercury as a buffer gas in the lamp. Upon cooling, the iodine condensed and the arc tube became clear. The lamp could easily be re-ignited. As the lamp regained operating temperature, the voltage rose to much higher values, and the original efficacy was never again achieved.

Examples of lamps that had experienced a runaway condition due to wall reactions were analyzed. It was observed that crystals of scandium silicate appeared in the degraded regions.

Mercury-fee, metal halide arc lamps with sodium/scandium chemistries and capillary envelopes (80 mm arc length by 6 mm to 10 mm bores) can operate with attractive performance measures. Efficacies of 95 LPW, CCTs of 4000° Kelvin, and CRIs of 65 Ra depict good performance. Although some of the lamps operated at greater than 90 volts, the best performances occurred at 50 volts. Xenon is more efficient than argon as a buffer gas in mercury-free lamps, consistent with observations of mercury lamps. Wall reactions between scandium or scandium salts are the limiting factors in the performance of mercury-free lamps with sodium/scandium chemistries. The products of the reaction are copious free iodine and scandium silicate. There is a threshold temperature above which the reactions take place rapidly.

Cesium is known to reduce wall reactions in mercury-metal halide lamps, and temperature in the smaller bore mercury-free lamps.

The response models predict that lamps with either 11:1 Na/Sc, or 11:1 Na/SciCs can reach 90 LPW operation and 4000° Kelvin, at temperatures below the wall reaction threshold. Color renditions of 65 Ra are marginally achievable below the threshold temperature. The models predict that only the small bore lamps operating above the threshold temperature will reach 100 volts.

The 5:1 and 6:1 Na/Sc chemistries are slightly more efficacious than are the 11:1 Na/Sc chemistries, but cannot achieve the CCT, CRI and voltage goals at temperatures below the threshold.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A mercury-free, arc vessel constructed of fused silica having a pinched-seal at each end and having an aspect ratio greater than 5 and containing a fill comprised of iodides selected from the group consisting of sodium, scandium, lithium, cesium and a buffer gas selected from the group consisting of xenon, argon and krypton.

2. A mercury-free, metal halide lamp comprising; an outer envelope containing an atmosphere selected from the group consisting of vacuum and nitrogen; and an arc discharge vessel constructed of fused silica having a pinched-seal at each end and mounted therein; said vessel having an aspect ratio greater than 5 and containing a fill comprised of iodides selected from the group consisting of sodium, scandium, lithium or cesium and a buffer gas of from about 50 torr to 500 torr selected from the group consisting of xenon, argon and krypton.

3. The lamp of claim 2 wherein said lamp is operated by a ballast supplying power to operate said lamp between approximately 250 watts and 400 watts.

* * * * *